US006880267B2

(12) United States Patent
Smaldone et al.

(10) Patent No.: US 6,880,267 B2
(45) Date of Patent: Apr. 19, 2005

(54) ARTICLE OF FOOTWEAR HAVING A SOLE STRUCTURE WITH ADJUSTABLE CHARACTERISTICS

(75) Inventors: Patricia L. Smaldone, Portland, OR (US); John Hurd, Tigard, OR (US); Kevin Hoffer, Portland, OR (US); Stann Norman Richard Sheperd, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 10/767,710

(22) Filed: Jan. 28, 2004

(65) Prior Publication Data

US 2004/0181969 A1 Sep. 23, 2004

Related U.S. Application Data

(62) Division of application No. 10/339,011, filed on Jan. 8, 2003.

(51) Int. Cl.[7] ..... A43B 13/18
(52) U.S. Cl. ..... 36/28; 36/35 R
(58) Field of Search ..... 36/30 R, 28, 27, 36/37, 25 R, 35 R

(56) References Cited

U.S. PATENT DOCUMENTS

| | | | |
|---|---|---|---|
| 507,490 | A | 10/1893 | Gambino |
| 607,086 | A | 7/1898 | Safford |
| 622,673 | A | 4/1899 | Ferrata |
| 933,422 | A | 9/1909 | Dee |
| 949,754 | A | 2/1910 | Busky |
| 1,094,211 | A | 4/1914 | Jenoi et al. |
| 1,099,180 | A | 6/1914 | Karacsonyi |
| 1,102,343 | A | 7/1914 | Kovacs |
| 1,272,490 | A | 7/1918 | Matear |
| 1,278,320 | A | 9/1918 | Ellithorpe |

(Continued)

FOREIGN PATENT DOCUMENTS

| | | |
|---|---|---|
| CH | 570 130 | 9/1974 |
| DE | 806 647 | 2/1949 |
| DE | 1 485 654 | 1/1965 |
| DE | 3400997 | 7/1985 |
| ES | 2 080 933 | 1/1990 |
| ES | 1 036 287 | 1/1997 |
| FR | 465267 | 4/1914 |
| FR | 1227420 | 4/1960 |
| FR | 2 556 188 | 6/1985 |
| GB | 21594 | 7/1903 |
| GB | 7163 | 10/1906 |
| GB | 2 032 761 | 5/1980 |
| GB | 2 173 987 A | 10/1986 |
| JP | 146188 | 11/1990 |
| SU | 1526637 A1 | 12/1989 |

OTHER PUBLICATIONS

US 4,974,345, 12/1990, Yung-Mao (withdrawn)

Article entitled "Hoop Dreams" (Applicant does not know the date of publication; however, it is believed that the publication date for this reference is at least one year prior to the Jan. 8, 2003 filing date for the present application), 1 page.

(Continued)

*Primary Examiner*—Ted Kavanaugh
(74) *Attorney, Agent, or Firm*—Banner & Witcoff, Ltd.

(57) ABSTRACT

The invention is a system for modifying characteristics of an article of footwear, particularly the sole structure. The footwear may include a plurality of discrete, vertically-projecting, columnar elements that extend between upper and lower portions of a cavity formed in the sole structure. At least one of the columnar elements includes a void that is configured to receive an insert. The void is accessible from the exterior of the footwear and the insert may be interchanged with an alternate insert that has different physical characteristics, thereby modifying the characteristics of the footwear.

14 Claims, 11 Drawing Sheets

U.S. PATENT DOCUMENTS 1,338,817 A 5/1920 DeLuca
1,502,087 A 7/1924 Bunns
1,670,747 A 5/1928 Sestito
1,870,065 A 8/1932 Nusser
1,870,114 A 8/1932 Heller
2,104,924 A 1/1938 Dellea
2,122,108 A 6/1938 Modlin
2,198,228 A 4/1940 Pinaud, et al.
2,299,009 A 10/1942 Denk
2,437,227 A 3/1948 Hall
2,710,460 A 6/1955 Stasinos
2,721,400 A 10/1955 Israel
2,885,797 A * 5/1959 Chrencik ..... 36/91
3,041,746 A 7/1962 Rakus
3,429,545 A 2/1969 Michel
3,822,490 A 7/1974 Murawski
4,000,566 A 1/1977 Famolare, Jr.
4,030,213 A 6/1977 Daswick
4,074,446 A 2/1978 Eisenberg
4,183,156 A 1/1980 Rudy
4,219,945 A 9/1980 Rudy
4,223,457 A 9/1980 Borgeas
4,237,625 A 12/1980 Cole et al.
4,241,523 A 12/1980 Daswick
4,262,433 A 4/1981 Hagg et al.
4,267,648 A 5/1981 Weisz
4,271,606 A 6/1981 Rudy
4,271,607 A 6/1981 Funck
4,314,413 A 2/1982 Dassler
4,318,232 A * 3/1982 Ching ..... 36/73
4,319,412 A 3/1982 Muller et al.
4,342,158 A 8/1982 McMahon et al.
4,364,188 A 12/1982 Turner et al.
4,399,621 A 8/1983 Dassler
4,430,810 A 2/1984 Bente
4,439,936 A 4/1984 Clarke et al.
4,492,046 A 1/1985 Kosova
4,494,321 A 1/1985 Lawlor
4,535,553 A 8/1985 Derderian
4,536,974 A 8/1985 Cohen
4,546,555 A 10/1985 Spademan
4,559,366 A 12/1985 Hostettler
4,566,206 A 1/1986 Weber
4,573,279 A 3/1986 Feurer-Zogel et al.
4,592,153 A 6/1986 Jacinto
4,594,799 A 6/1986 Lin
4,598,484 A 7/1986 Ma
4,598,487 A 7/1986 Misevich
4,610,099 A 9/1986 Signori
4,616,431 A 10/1986 Dassler
4,624,062 A 11/1986 Autry
4,638,575 A 1/1987 Illustrato
4,638,577 A 1/1987 Riggs
4,660,299 A 4/1987 Omilusik
4,680,875 A 7/1987 Danieli
4,680,876 A 7/1987 Peng
4,709,489 A 12/1987 Welter
4,715,130 A 12/1987 Scatena
4,722,131 A 2/1988 Huang
4,731,939 A 3/1988 Parracho et al.
4,733,483 A 3/1988 Lin
4,746,555 A 5/1988 Luckanuck
4,753,021 A 6/1988 Cohen
4,774,774 A 10/1988 Allen, Jr.
D298,583 S 11/1988 Yung-Mao
4,794,707 A 1/1989 Franklin et al.
4,798,009 A 1/1989 Colonel et al.
4,802,289 A 2/1989 Guldager
4,815,221 A 3/1989 Diaz
4,843,737 A 7/1989 Vorderer
4,843,741 A 7/1989 Yung-Mao
4,845,863 A 7/1989 Yung-Mao
4,878,300 A 11/1989 Bogaty
4,881,328 A 11/1989 Yung-Mao
4,881,329 A 11/1989 Crowley
4,887,367 A 12/1989 Mackness et al.
4,905,382 A 3/1990 Lin
4,908,962 A 3/1990 Yung-Mao
4,910,884 A 3/1990 Lindh et al.
4,918,838 A 4/1990 Chang
4,936,029 A 6/1990 Rudy
4,956,927 A 9/1990 Misevich et al.
4,984,320 A * 1/1991 Curley et al. ..... 14/146 BR
4,984,376 A 1/1991 Walter et al.
D315,634 S 3/1991 Yung-Mao
5,005,300 A 4/1991 Diaz et al.
5,014,449 A 5/1991 Richard et al.
5,068,981 A 12/1991 Jung
5,092,060 A 3/1992 Frachey et al.
5,138,776 A 8/1992 Levin
5,212,878 A * 5/1993 Burke et al. ..... 36/27
5,222,312 A 6/1993 Doyle
5,224,278 A * 7/1993 Jeon ..... 36/29
5,233,767 A 8/1993 Kramer
5,343,639 A 9/1994 Kilgore et al.
5,353,523 A 10/1994 Kilgore et al.
5,560,126 A 10/1996 Meschan et al.
5,572,804 A 11/1996 Skaja et al.
5,615,497 A 4/1997 Meschan
5,685,090 A 11/1997 Tawney et al.
5,782,014 A 7/1998 Peterson
5,806,210 A 9/1998 Meschan
5,826,352 A 10/1998 Meschan et al.
5,853,844 A 12/1998 Wen
5,976,451 A 11/1999 Skaja et al.
6,018,889 A 2/2000 Friton
6,055,747 A 5/2000 Lombardino
6,115,944 A 9/2000 Lain
6,131,310 A 10/2000 Fang
D433,216 S 11/2000 Avar et al.
6,233,846 B1 5/2001 Sordi
6,305,100 B1 10/2001 Komarnycky et al.
6,324,772 B1 12/2001 Meschan
6,457,261 B1 10/2002 Crary

OTHER PUBLICATIONS

Advertisement for Aura "Introducing the exciting new performance driven 2001 Aura," 1 page.

Web page translation using babelfish, entitled "The tennis shoe with the motivating force" (Applicant does not know the date of publication; however, it is believed that the publication date for this reference is at least one year prior to the Jan. 8, 2003 filing date for the present application), 2 pages.

FWN, vol. 46, No. 38, Sep. 17, 1990, "Marco Scatena puts spring in Athlon wearers' control," 1 page.

Spring– and Shock Absorber Bearing Spring Elements Springing Comfort with High Damping (Applicant does not know the date of publication; however, it is believed that the publication date for this reference is at least one year prior to the Jan. 8, 2003 filing date for the present application), 3 pages.

Activ Power Spring System catalog, front and back pages with English translation of back page, 3 pages.

* cited by examiner

ARTICLE OF FOOTWEAR HAVING A SOLE STRUCTURE WITH ADJUSTABLE CHARACTERISTICS

CROSS-REFERENCE TO RELATED APPLICATION

This U.S. patent application is a divisional application of and claims priority to U.S. patent application Ser. No. 10/339,011, which was filed in the U.S. Patent and Trademark Office on Jan. 8, 2003 and entitled Article Of Footwear Having A Sole Structure With Adjustable Characteristics, such prior U.S. patent application being entirely incorporated herein by reference.

BACKGROUND OF THE INVENTION

1. Field of the Invention

The present invention relates to the field of footwear. The invention concerns, more particularly, a footwear sole structure with interchangeable inserts that modify characteristics of the sole structure.

2. Description of Background Art

Conventional articles of athletic footwear include an upper and a sole structure that are specifically designed for use in particular athletic activities. Running shoes, for example, incorporate a lightweight upper that provides the foot with ventilation, thereby decreasing the overall weight of the footwear and removing perspiration from the area surrounding the foot. Sole structures for running shoes are generally designed to provide a high degree of cushioning, which includes ground reaction force attenuation and energy absorption, and may incorporate motion control components for reducing the inward roll of the foot following footstrike. Basketball shoes generally incorporate an upper that protects the ankle from sprains and a sole that provides stability during the commonly executed lunges and quick direction changes. Finally, the sole structures for soccer shoes and football shoes may incorporate spikes that provide a high degree of traction on natural turf playing fields.

Despite the differences between the various footwear styles, sole structures for conventional footwear generally include multiple layers that are referred to as an insole, a midsole, and an outsole. The insole is a thin, cushioning member located adjacent to the foot that enhances footwear comfort. The midsole forms the middle layer of the sole and serves a variety of purposes that include controlling potentially harmful foot motions, such as over pronation; shielding the foot from excessive ground reaction forces; and beneficially utilizing such ground reaction forces for more efficient toe-off. The outsole forms the ground-contacting element of footwear and is usually fashioned from a durable, wear resistant material that includes texturing to improve traction.

The primary element of a commonly-employed type of conventional midsole is a resilient, polymer foam material, such as polyurethane or ethylvinylacetate, that extends throughout the length and width of the footwear. In designing the midsole, footwear manufacturers balance the manner in which the midsole provides cushioning with stability. In general, a relatively thick midsole will provide greater cushioning than a relatively thin midsole, but will also have less stability than the relatively thin midsole.

As an alternative, U.S. Pat. Nos. 5,353,523 and 5,343,639 to Kilgore et al., hereby incorporated by reference, discloses an article of athletic footwear with a midsole that includes foam columns placed between semi-rigid upper and lower plates. In general, the foam columns support the entire heel portion of the foot. The heel portion of a conventional article of footwear generally includes a block of foam material and may incorporate fluid-filled bladders, as disclosed in U.S. Pat. Nos. 4,183,156 and 4,219,945 to Rudy. In contrast, the heel portion of the footwear disclosed in the Kilgore patents includes foam columns and a void that extends through the columns. Unlike many conventional midsole materials, therefore, the foam columns generally utilize a foam with higher density to provide greater support per unit-volume of foam material.

The performance characteristics of the foam columns disclosed in the Kilgore patents are primarily dependent upon factors that include the dimensional configurations of the columns and the properties of the foam material selected for the columns. By designing the columns to have specific dimensions and foam properties, cushioning and stability of the footwear may be generally tuned to meet the specific demands of the activity for which the footwear is intended to be used. In running shoes, for example, the dimensions and foam properties may be selected to provide greater cushioning. Similarly, the configuration of the columns may also be selected to provide enhanced stability in basketball shoes.

As stated above, cushioning and stability may be generally tuned to meet the specific demands of a particular activity. In general, the dimensions and foam properties will be selected to accommodate specific weights of the wearer, a generally preferred degree of cushioning, a particular activity, a specific ground surface, and a certain degree of motion control. A particular pair of footwear, however, may be purchased and worn by individuals with a wide range of weights that prefer different degrees of cushioning. In addition, the footwear may be used for varying activities on ground surfaces with a wide variety of compliance characteristics. In addition, different wearers may require different degrees of pronation or supination control. Predetermined column dimensions and foam properties may not be sufficient, therefore, to accommodate the requirements and preferences of all wearers that may utilize a particular pair of footwear.

SUMMARY OF THE INVENTION

The present invention is an article of footwear with an upper for receiving a foot of a wearer and a sole structure attached to the upper. The sole structure includes at least one discrete, vertically-projecting, columnar element positioned within a cavity formed in the sole structure. The columnar element includes a void that is accessible from an exterior of the footwear. The void receives a first insert that is removable from the void, and the sole structure may include a plurality of alternate inserts that are separate from the footwear. Each alternate insert has a physical property that is different from a physical property of the first insert, and each alternate insert is interchangeable with the first insert to modify a characteristic of the sole structure. The first insert and alternate inserts each include a first securing portion of a securing mechanism and the sole structure includes a corresponding securing portion of the securing mechanism. The first securing portion is joinable with the corresponding securing portion to secure one of the first insert and the alternate inserts within the void.

The securing mechanism may have a variety of configurations within the scope of the present invention. For example, the first securing portion of the securing mechanism may include a protrusion, and the corresponding securing portion may be a channel, inclined plane, and receptacle formed in the sole structure. When properly placing the first insert into the void, the protrusion will travel upward through the channel, across the inclined plane, and become seated within the receptacle. Alternately, other types of securing mechanisms may be utilized to secure the first insert and the alternate inserts within the voids.

The columnar element may be positioned between a top plate and a bottom plate formed of a rigid or semi-rigid material. The bottom plate is located adjacent an outsole, and both the bottom plate and the outsole form an aperture for receiving the inserts. The corresponding securing portion may be formed in the bottom plate. Alternately, however, the corresponding securing portion may be formed in the bottom plate and adjacent the aperture.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Introduction

Figure 1:
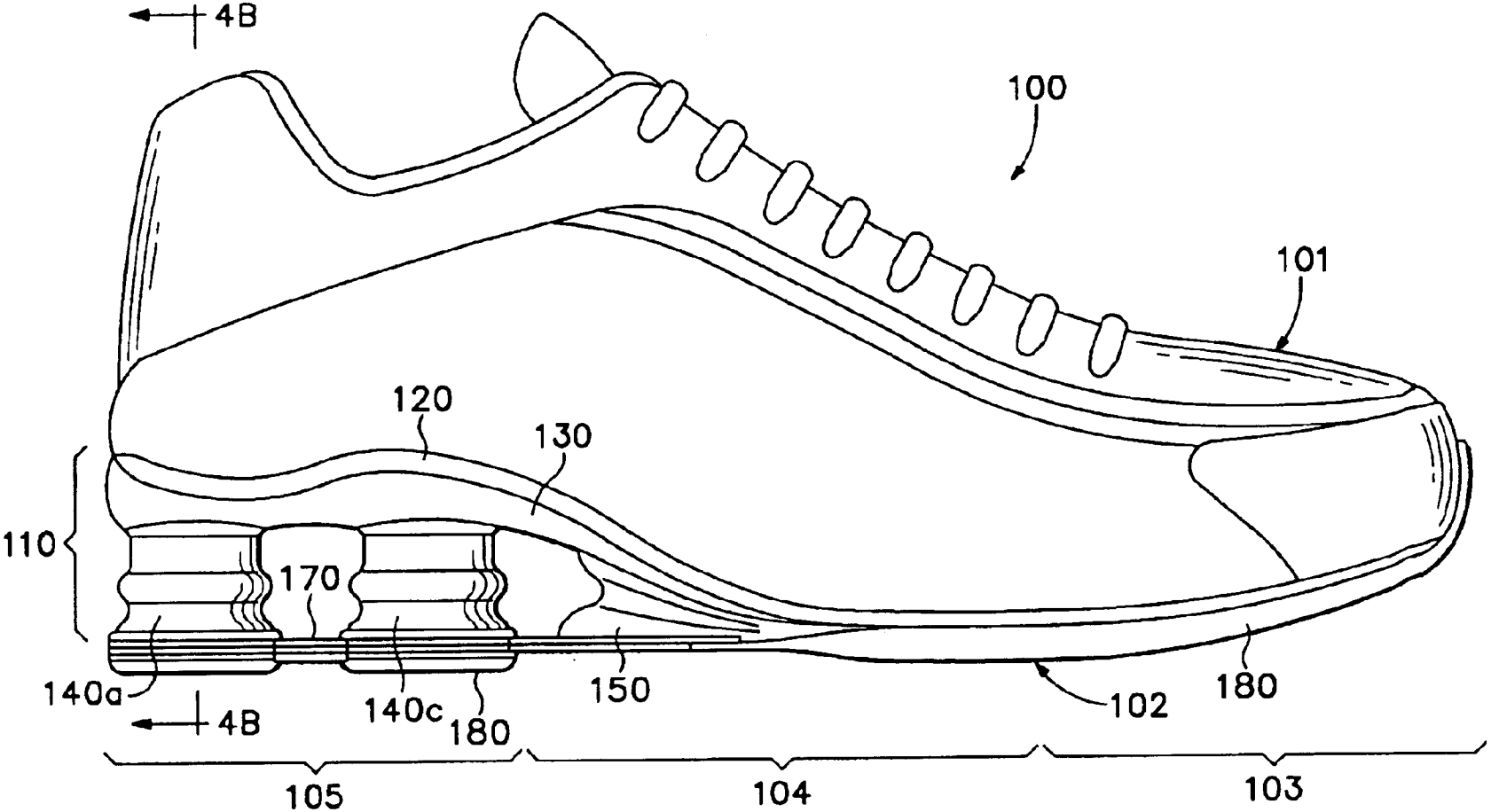
FIG. 1 is a lateral elevation view of an article of footwear in accordance with a first embodiment of the present invention.
Figure 2:
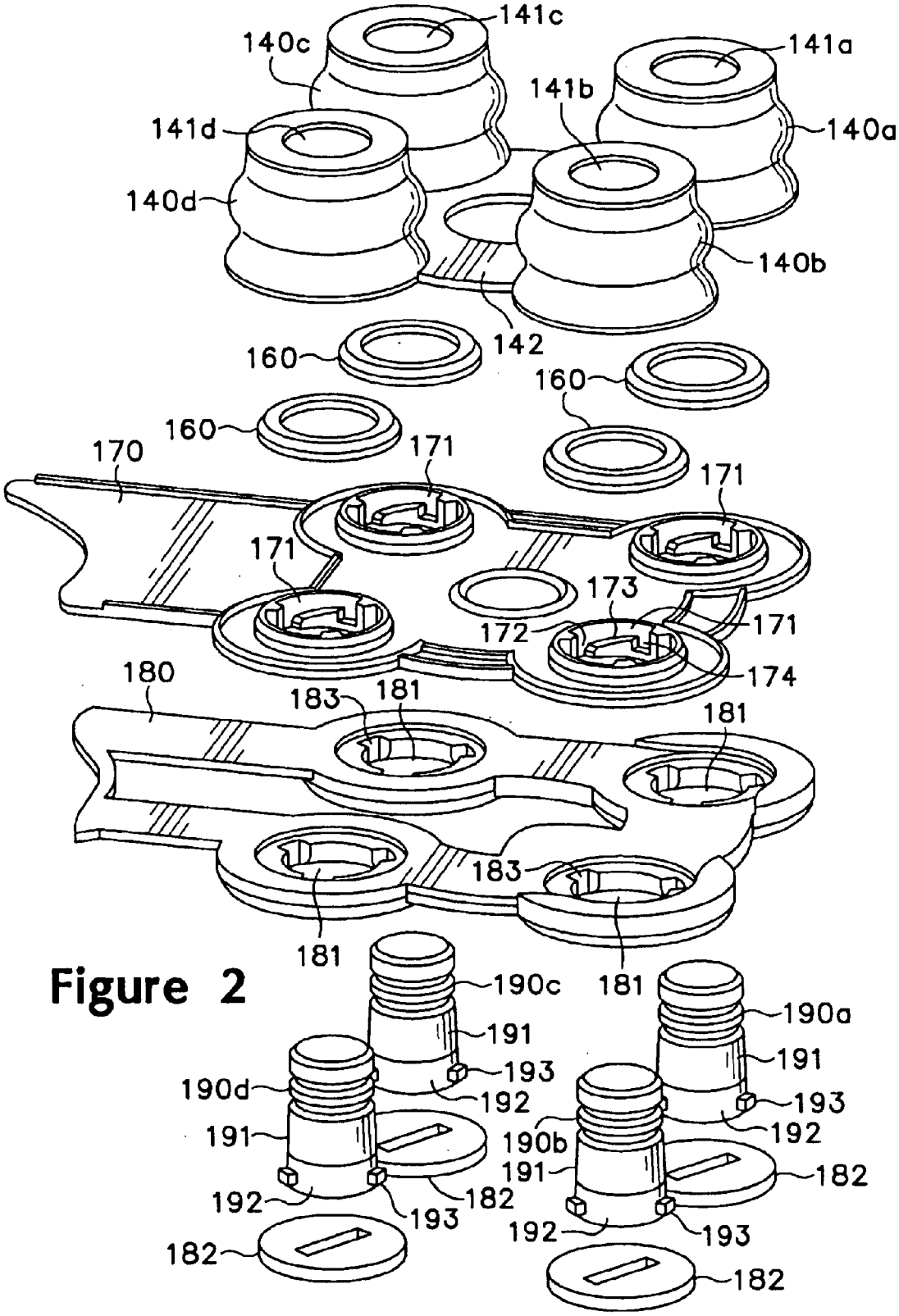
FIG. 2 is an exploded perspective view of a portion of a sole structure of the footwear depicted in FIG. 1.
Figure 3:
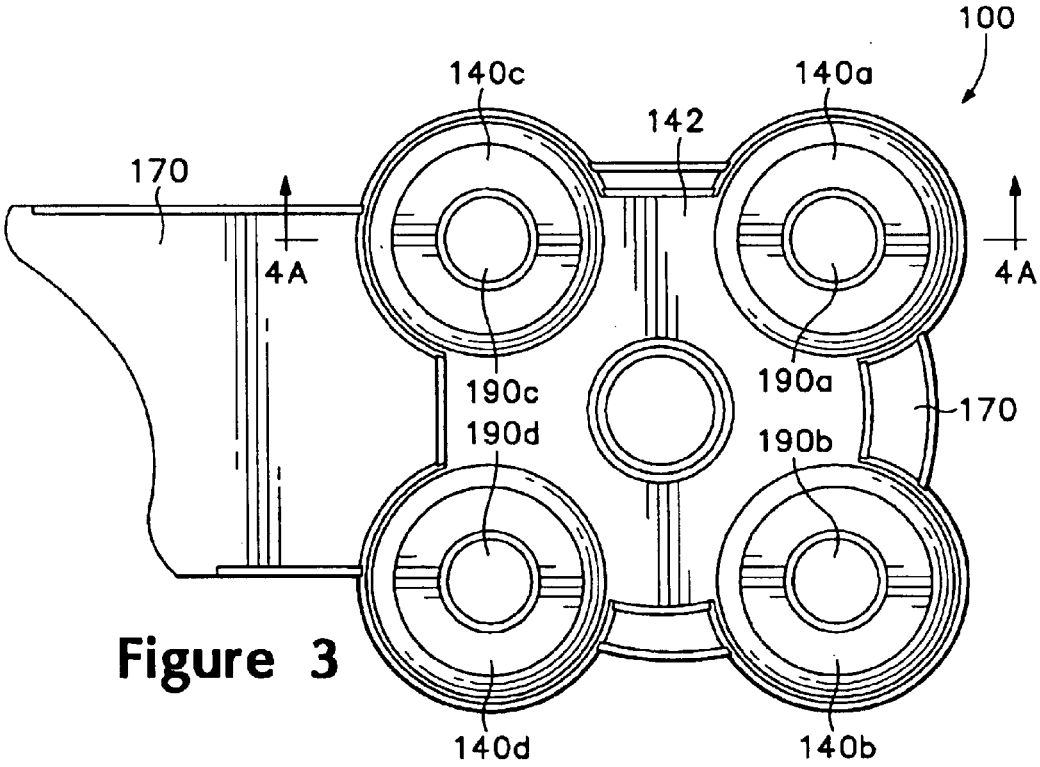
FIG. 3 is a top plan view of the portion depicted in FIG. 2.

Referring to the figures and following discussion, articles of footwear 100, 200, and 300 in accordance with the present invention are disclosed. Footwear 100 and 200 are depicted and discussed as running shoes, and footwear 300 is depicted and discussed as a basketball shoe. The concepts disclosed with respect to footwear 100, 200, and 300 may, however, be applied to a wide range of other athletic footwear styles, including walking shoes, tennis shoes, soccer shoes, football shoes, and cross-training shoes, for example. In addition, the concepts of the present invention may be applied to a wide range of non-athletic footwear, including work boots, sandals, loafers, and dress shoes. Accordingly, the present invention is not limited to the precise embodiments disclosed herein, but applies to footwear generally.

First Embodiment

Footwear 100 is depicted in FIGS. 1–5 and includes an upper 101 that is connected to a sole structure 102. Upper 101 may be a conventional or non-conventional upper that includes, for example, layers of foam materials, synthetic textiles, and leather that are stitched or adhesively bonded to each other to form a comfortable structure for receiving a foot. Sole structure 102 may include an insole which is a thin cushioning member generally located within upper 101 and at a position that corresponds with the sole of the foot, thereby enhancing the comfort of footwear 100. Sole structure 102 also includes a midsole 110 that forms the primary cushioning layer of footwear 100 and serves, therefore, to attenuate ground reaction forces and absorb energy when footwear 100 is compressed against the ground. The primary components of midsole 110 are a foam layer 120, a top plate 130, four columnar elements 140*a*–140*d*, a midfoot wedge 150, rings 160, and a bottom plate 170. In addition, sole structure 102 includes an outsole 180 and a plurality of inserts 190*a*–190*d*. Outsole 180 forms the primary ground-contacting surface of footwear 100 and may be fashioned from a wear-resistant material, such as carbon black rubber compound, and may include texturing to enhance traction. Inserts 190*a*–190*d* are removable from footwear 100 and extend through outsole 180 and into midsole 110. More particularly, inserts 190*a*–190*d* are configured to extend into interior portions of columnar elements 140*a*–140*d*, respectively.

During running or other activities that compress sole structure 102 between the foot and the ground, footwear 100 provides the individual with cushioning. That is, footwear 100 attenuates ground reaction forces and absorbs energy that would otherwise be transferred to the leg and foot of the individual. The degree of cushioning provided by footwear 100 is generally related to the overall stiffness of sole structure 102. In general, a greater stiffness corresponds with lesser cushioning, whereas lesser stiffness corresponds with greater cushioning. Accordingly, stiffness and cushioning are generally correlated through an inverse relationship.

In conventional footwear, the stiffness of the sole structure is predetermined by the footwear manufacturer. Not all individuals, however, require or prefer the specific degree of stiffness that is predetermined by the footwear manufacturer. Individuals of different mass may prefer a sole structure that provides different degrees of stiffness. At a minimum, however, the selected stiffness should be sufficient to prevent top plate 130 from contacting bottom plate 170 as the person walks, runs, jumps, or otherwise compresses sole structure 102. Some individuals may also prefer a sole structure that exhibits lesser stiffness for some activities and greater stiffness for other activities. In addition, individuals may prefer greater stiffness on compliant surfaces, such as dirt, turf, or sand, and lesser stiffness on non-compliant surfaces, such as concrete or asphalt. Furthermore, an individual who over-pronates or over-supinates may prefer that the lateral side and the medial side of an article of footwear exhibit different degrees of stiffness.

In contrast with conventional articles of footwear that have predetermined degrees of stiffness in the sole structure, footwear 100 incorporates an adjustment mechanism that permits an individual to modify the stiffness characteristics, as well as other characteristics, of sole structure 102. The primary determinant of the stiffness in sole structure 102 is the combination of columnar elements 140*a*–140*d* and inserts 190*a*–190*d*. As discussed above, inserts 190*a*–190*d* extend through outsole 180 and into columnar elements 140*a*–140*d*, respectively. By varying the physical properties of inserts 190*a*–190*d*, the stiffness of sole structure 102 may be altered, as discussed in greater detail below. In addition to the stiffness of sole structure 102, characteristics such as the manner in which sole structure 102 controls the motion of the foot may be modified, for example.

The various elements of sole structure 102 will now be discussed in detail. To aid in the following discussion, footwear 100 may be divided into three general regions: a fore region 103 that generally corresponds with a front portion of the foot, including the toes; a midfoot region 104 that generally corresponds with a middle portion of the foot that includes the arch; and a heel region 105 that generally corresponds with the heel. Regions 103–105 are not intended to demarcate precise areas of footwear 100. Instead, regions 103–105 are intended to define general areas that aid in the following discussion.

Foam layer 120 is attached directly to upper 101 throughout the length of footwear 100 and supplies a portion of the cushioning provided by sole structure 102. In fore region 103, foam layer 120 extends between upper 101 and outsole 180. In heel region 105 and a portion of midfoot region 104, however, foam layer 120 extends between upper 101 and top plate 130. An upper surface of foam layer 120 may be contoured to conform to the shape of the foot. Accordingly, foam layer 120 may include a raised arch on the medial side of midfoot region 104, raised peripheral areas extending around sides of the foot, and a depression for receiving the heel, for example. The thickness of foam layer 120 may vary along the length of footwear 100. For example, foam layer 120 may have a relatively constant thickness in heel region 105 and midfoot region 104. In fore region 103, however, the thickness of foam layer 120 may decrease to a point at the front of footwear 100. Suitable materials for foam layer 120 include foam materials, such as ethylvinylacetate and polyurethane foam, which are commonly incorporated into the midsoles of conventional footwear.

Top plate 130 is attached to the lower surface of foam layer 120 in heel region 105 and midfoot region 104. The upper surface of top plate 130 may form a depression for receiving the heel. The lower surface of top plate 130 is connected to columnar elements 140*a*–140*d*, and the primary purpose of top plate 130 is to provide a semi-rigid structure that supports the foot in heel region 105 and distributes forces among columnar elements 140*a*–140*d*. Suitable materials for top plate 130 include a plurality of lightweight, durable polymer materials having a moderate flexural modulus, such as polyester, nylon, or a polyether block copolyamide. Top plate 130 may also be formed of a composite material that is a combination of a polymer and a plurality of fibers or particulates, such as glass or carbon fibers. Footwear 100 is structured to support the foot such that the heel is raised above the toes, with the transition from the higher heel area to the lower toe area occurring in midfoot region 104. Accordingly, top plate 130 is generally horizontal in heel region 105, but angles downward in midfoot region 104 to provide the transition.

Columnar elements 140*a*–140*d* are vertically-projecting components that, in combination with inserts 190*a*–190*d*, are the primary determinant of the stiffness in sole structure 102. As depicted in FIGS. 1–5, footwear 100 includes four columnar elements 140*a*–140*d* that are positioned as follows: columnar element 140*a* is positioned in a rear-lateral corner of footwear 100; columnar element 140*b* is positioned in a rear-medial corner of footwear 100; columnar element 140*c* is positioned forward of columnar element 140*a* and on a lateral side of footwear 100; and columnar element 140*d* is positioned forward of columnar element 140*b* and on a medial side of footwear 100. Alternately, footwear 100 may include a lesser or greater number of columnar elements 140*a*–140*d*, and columnar elements 140*a*–140*d* may be positioned in other portions of footwear 100, including fore region 103 and midfoot region 104.

Columnar elements 140*a*–140*d* have a vertically-projecting structure and are positioned within a cavity formed between top plate 130 and bottom plate 170. Each columnar element 140*a*–140*d*, therefore, extends upward between bottom plate 170 and top plate 130 to provide support for top plate 130 in heel area 105. As depicted, columnar elements 140*a*–140*d* have a generally cylindrical structure, but may have a plurality of other structural shapes within the scope of the present invention, including the shape of a cone, a pyramid, a cube, or a sphere, for example. The exterior surface of columnar elements 140*a*–140*d* may be smooth, or may include contours. As depicted in the figures, columnar elements 140*a*–140*d* each have a protrusion that circumscribes an exterior surface of columnar elements 140*a*–140*d*. In alternate embodiments, columnar elements 140*a*–140*d* may include a separate ring that is seated within an indentation in the exterior surface, or may include no ring. Accordingly, columnar elements 140*a*–140*d* may have a wide range of configurations within the scope of the present invention.

As depicted in the figures, columnar elements 140*a*–140*d* each include a void 141 that extends along longitudinal axes of columnar elements 140*a*–140*d*. Within the scope of the present invention, however, it is not necessary that all columnar elements 140*a*–140*d* include a void 141. In certain applications, only one of columnar element 140*a*–140*d* may include a void 141. In general, voids 141 are configured to receive one of a plurality of inserts 190*a*–190*d*. Columnar elements 140*a*–140*d* may also be connected by an integral base 142. Despite the presence of base 142, columnar elements 140*a*–140*d* have a discrete configuration wherein each individual columnar element 140*a*–140*d* extends in the upward direction.

In combination with inserts 190*a*–190*d*, columnar elements 140*a*–140*d* determine the overall stiffness in sole structure 102. As discussed above, stiffness is related to cushioning. Columnar elements 140*a*–140*d* supply a significant portion of the cushioning provided by sole structure 102, and the materials selected for columnar elements 140*a*–140*d* should promote this purpose. Suitable materials for columnar elements 140*a*–140*d* are rubber, ethylvinylacetate, or polyurethane foam, for example, that returns energy in the range of at least 35 to 70% in a drop ball rebound test. Furthermore, a suitable material may have sufficient durability to maintain structural integrity when repeatedly compressed from 50 to 70% of its natural height in excess of 500,000 cycles. In addition, a microcellular foam having a specific gravity of 0.5 to 0.7 g/cm$^3$, a hardness of 70 to 76 on the Asker C scale, and a stiffness of 110 to 130 kN/m at 60% compression may be utilized. Alternatively, a microcellular elastomeric foam of the type disclosed in U.S. Pat. Nos. 5,353,523 and 5,343,639 to Kilgore et al., which have been incorporated by reference and discussed in the Description of Background Art section herein, may be utilized.

In addition to columnar elements 140*a*–140*d*, the area between top plate 130 and bottom plate 170 also includes midfoot wedge 150 which is positioned forward of columnar elements 140*a*–140*d*. The function of midfoot wedge 150 is to absorb impact forces and provide support to midfoot region 104 of footwear 100, thereby preventing a collapse of top plate 130 in midfoot region 104. An upper surface of midfoot wedge 150 is attached, possibly with an adhesive, to top plate 130. Similarly, a lower surface of midfoot wedge 150 is attached to bottom plate 170. Suitable materials for midfoot wedge 150 include the materials discussed above for columnar elements 140*a*–140*d*.

Figure 4A:
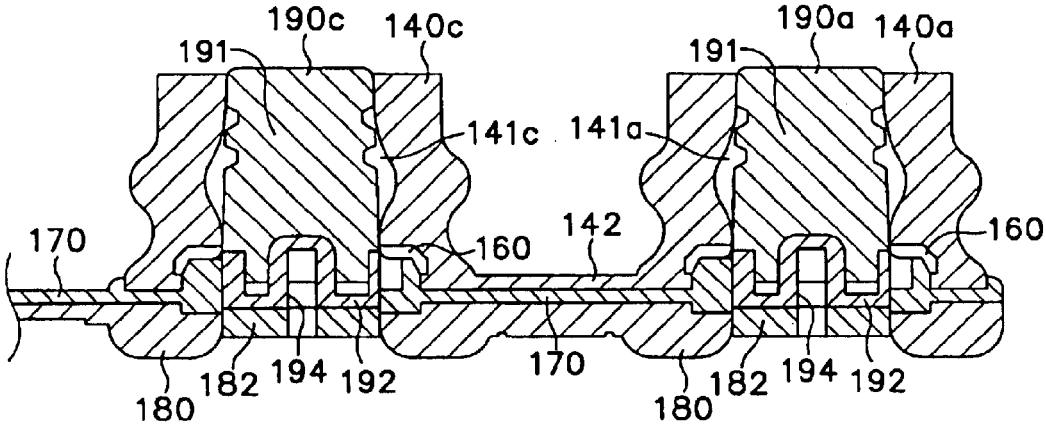
FIG. 4A is a cross-sectional view, as defined by line 4A—4A in FIG. 3.
Figure 4B:
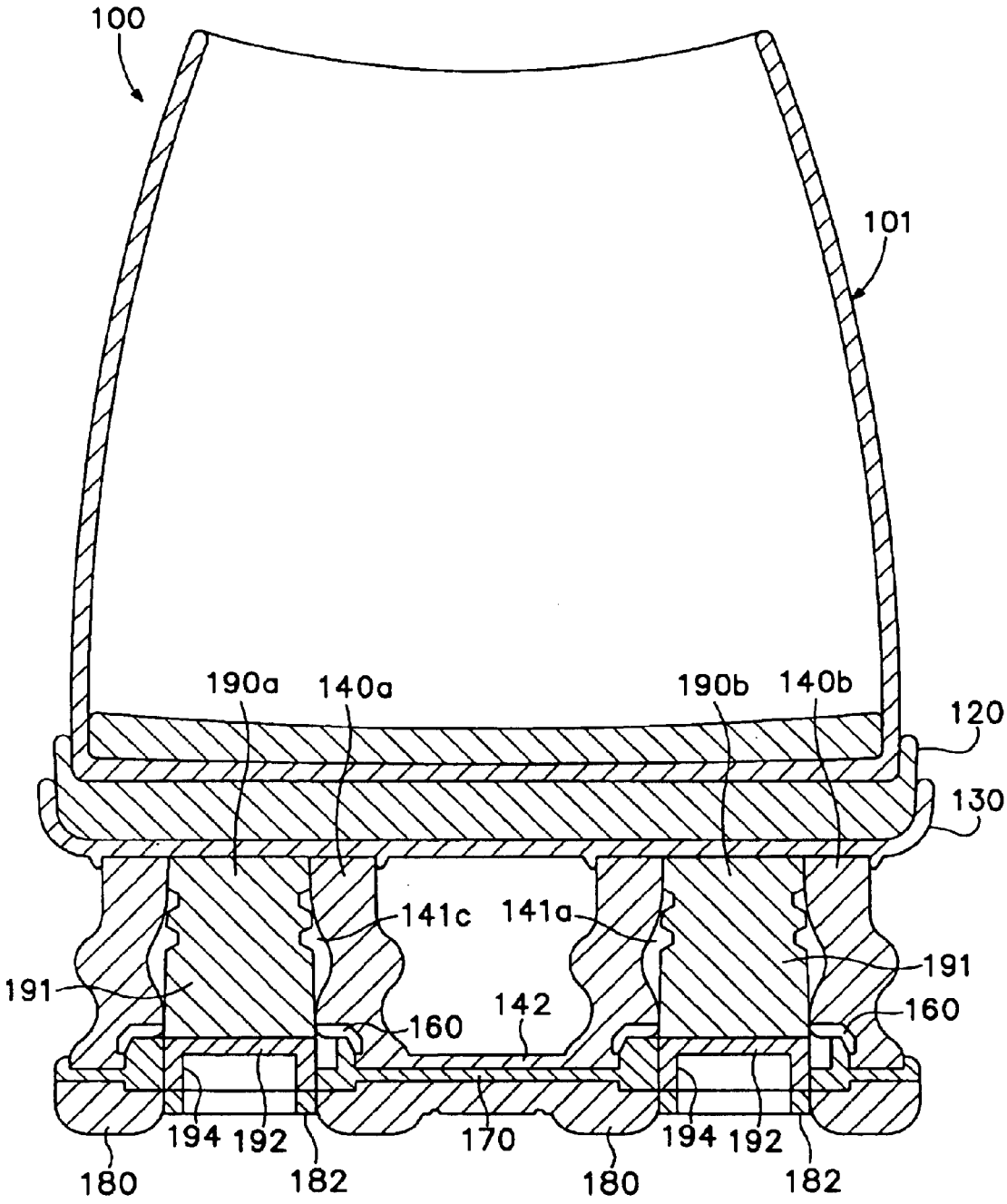
FIG. 4B is a cross-sectional view, as defined by line 4B—4B in FIG. 1.

Each columnar element 140*a*–140*d* may extend around one of rings 160. As depicted in FIG. 4A, a portion of bottom plate 170 may extend into voids 141 so as to contact rings 160. One purpose for rings 160 is to prevent overinsertion of inserts 190*a*–190*d*. Alternately, bottom plate 170 may be formed to achieve a similar purpose. Suitable materials for rings 160 include the materials discussed in relation to top plate 130.

Bottom plate 170 is positioned below columnar elements 140*a*–140*d* and rings 160, and may extend into midfoot region 104, thereby extending under midfoot wedge 150. Like top plate 130, bottom plate 170 provides a semi-rigid structure that distributes forces among columnar elements 140*a*–140*d*. When outsole 180 is compressed against the ground, an upward force is directed into bottom plate 170. If bottom plate 170 were formed of a highly flexible material, only the columnar elements 140*a*–140*d* located directly above the point of contact between outsole 180 and the ground would experience a compressive force.

Bottom plate 170 includes four apertures 171 that are aligned with voids 141 of columnar elements 140*a*–140*d*. As will be discussed in greater detail below, inserts 190*a*–190*d* extend into voids 141 by protruding through outsole 180 and bottom plate 170. Apertures 171, therefore, provide inserts 190*a*–190*d* with access to voids 141. In addition to providing access, apertures 171 also include a portion of a securing mechanism that secures the position of inserts 190*a*–190*d* in voids 141. The portion of the securing mechanism located in each aperture 171 includes channels 172, inclined planes 173, and receptacles 174, which will be described in greater detail below.

Outsole 180 is attached to a lower surface of bottom plate 170 in heel region 105 and midfoot region 104. In fore region 103, however, outsole 180 is attached to the lower surface of foam layer 120. Outsole 180 forms the primary ground-contacting surface of footwear 100 and may be fashioned from a wear-resistant material, such as carbon black rubber compound, that includes texturing to enhance traction. Like bottom plate 170, outsole 180 includes apertures 181 that are aligned with voids 141, and grooves 183 that are aligned with channels 172, thereby providing inserts 190*a*–190*d* with access to voids 141 through outsole 180. Outsole 180 may also include caps 182 that are positioned within apertures 181 and protect inserts 190*a*–190*d* from wear. Caps 182 may be formed from the same material that forms outsole 180, and caps 182 may be held in position by friction, for example. In addition, caps 182 may be permanently secured to inserts 190*a*–190*d*.

Inserts 190*a*–190*d* are configured to protrude through apertures 181 and 171, thereby extending into voids 141 of columnar elements 140*a*–140*d*, respectively. Each insert 190*a*–190*d* will generally be formed of a first portion 191 and a second portion 192 that are connected with an adhesive or molded as one unit, for example. First portions 191 form the majority of inserts 190*a*–190*d* and are positioned within voids 141 when inserts 190*a*–190*d* are connected to footwear 100. First portions 191 may be formed from a variety of materials having varying degrees of stiffness, compliance, and compressibility. In general, however, the materials forming first portions 191 will be similar to the materials that form columnar elements 140*a*–140*d*, but may have different material properties. Second portions 192 do not generally extend entirely into voids 141 and are primarily located within apertures 171 and 181 when inserts 190*a*–190*d* are connected to footwear 100. Suitable materials for second portions 192 may be a more rigid and durable material than the materials forming first portions 191, and may include the materials discussed in relation to top plate 130 and bottom plate 170. Alternately, the material forming second portions 192 may be the same as the material forming first portion 191. Second portions 192 also include one or more protrusions 193 that form a corresponding portion of the securing mechanism that secures the position of inserts 190*a*–190*d* in voids 141.

Upon inserting an individual one of inserts 190*a*–190*d* through apertures 171 and 181 and into void 141, first portion 191 will generally contact at least a portion of the surface of columnar elements 140*a*–140*d*, thereby filling a substantial portion of void 141, and second portion 192 will be positioned within apertures 171 and 181. In order to properly position second portion 192 in apertures 171 and 181, protrusions 193 travel upward through grooves 183 and channels 172. The selected one of insert 190*a*–190*d* is then rotated so that protrusions 193 slide along inclined planes 173 and drop into receptacles 174 formed in bottom plate 170. Accordingly, protrusions 193 are securely positioned within receptacles 174 when inserts 190*a*–190*d* are properly positioned with respect to footwear 100. Although inserts 190*a*–190*d* may be removable and insertable with the fingers of the individual, a removal device may also be supplied to assist with removal and insertion. As depicted in FIG. 4A, second portion 192 forms an indentation 194 that will receive the removal device, which may be any article that assists with the removal and insertion of inserts 190*a*–190*d*, and may be a common object, such as a screwdriver, a fingernail, or coin-type currency. A slot is also formed in cap 182 to provide the removal device with access to indentation 194.

Inserts 190*a*–190*d* are depicted in FIG. 4A as extending slightly above the top surface of columnar elements 140*a*–140*d*. When inserted into footwear 100, therefore, inserts 190*a*–190*d* are slightly compressed. In alternate embodiments, however, inserts 190*a*–190*d* may have a length that corresponds with the top surface of columnar elements 140*a*–140*d* or extends below the top surface of columnar elements 140*a*–140*d*.

Inserts 190*a*–190*d* may be structured to include indentations that circumscribe the exterior surface of first portion 191. The indentations may be utilized to identify the characteristics of inserts 190*a*–190*d*. For example, a ring located adjacent top portions of inserts 190*a*–190*d* may indicate a relatively hard material, whereas a ring located adjacent bottom portions of inserts may indicate a relatively soft material. Other indicia, such as numbers imprinted into the surface of inserts 190*a*–190*d* or differing colors are alternate ways of identifying the material characteristics.

Figure 5:
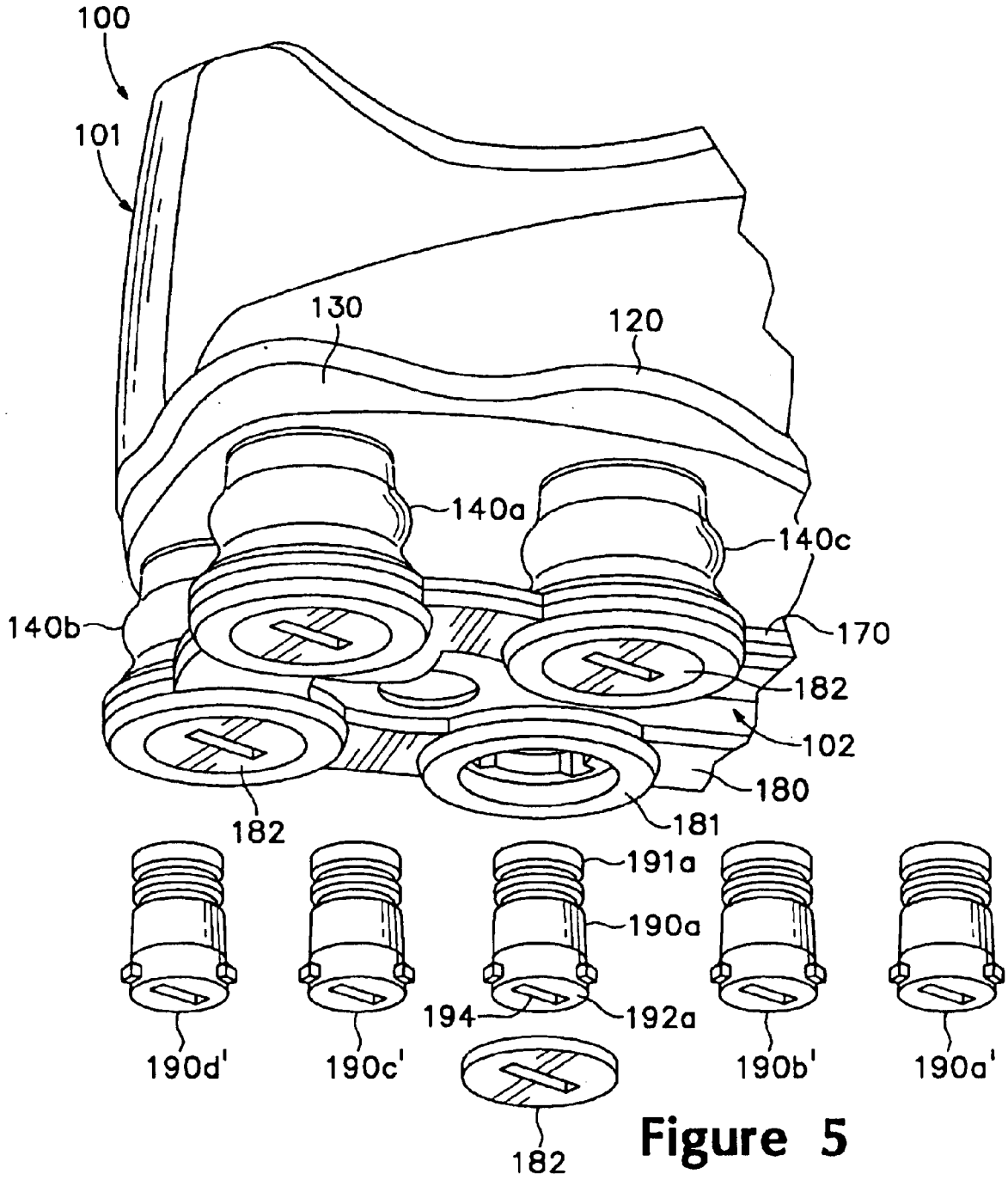
FIG. 5 is a perspective view of the footwear with a plurality of alternate inserts.
Figure 6:
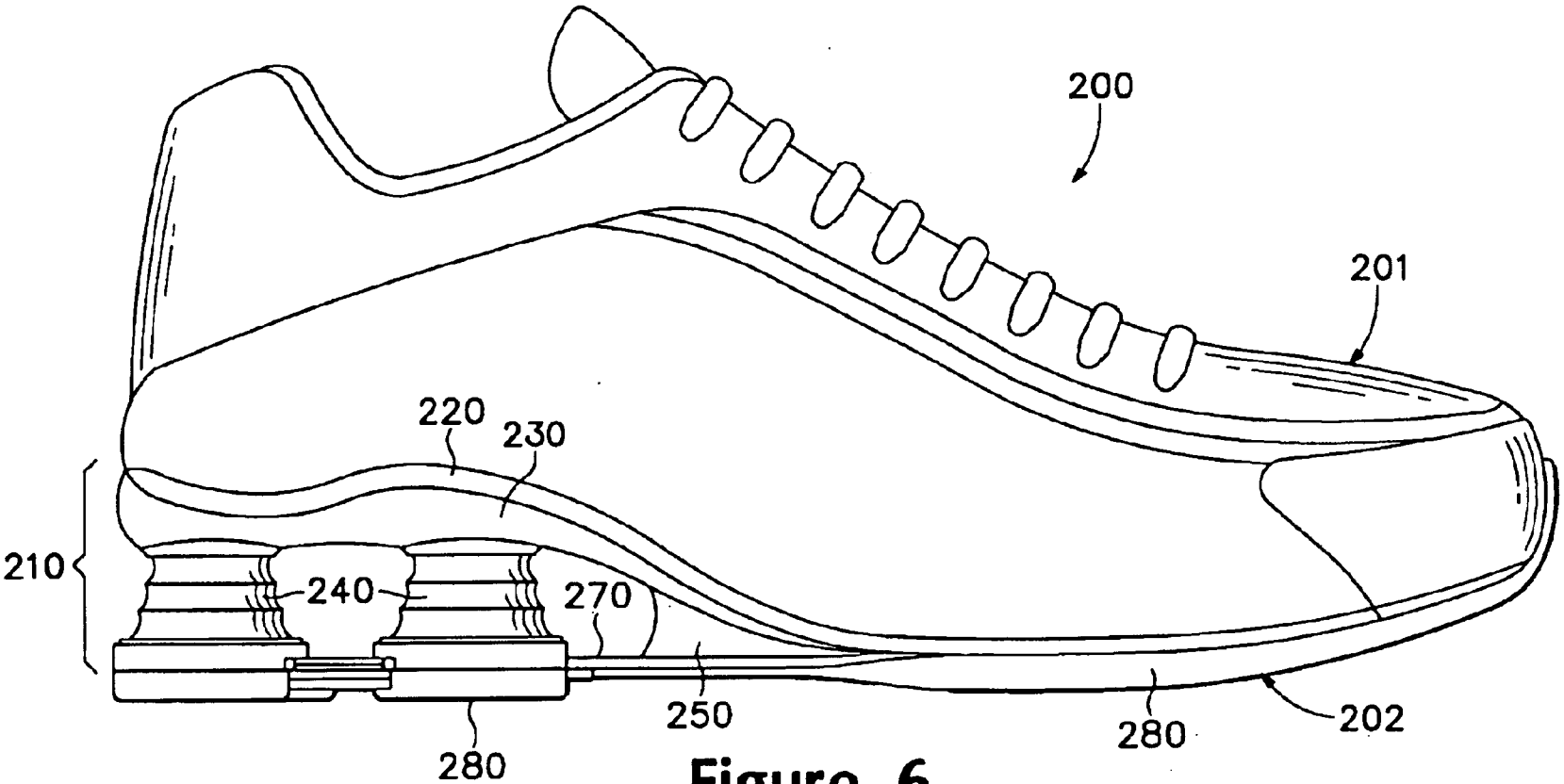
FIG. 6 is a lateral elevation view of an article of footwear in accordance with a second embodiment of the present invention.
Figure 7:
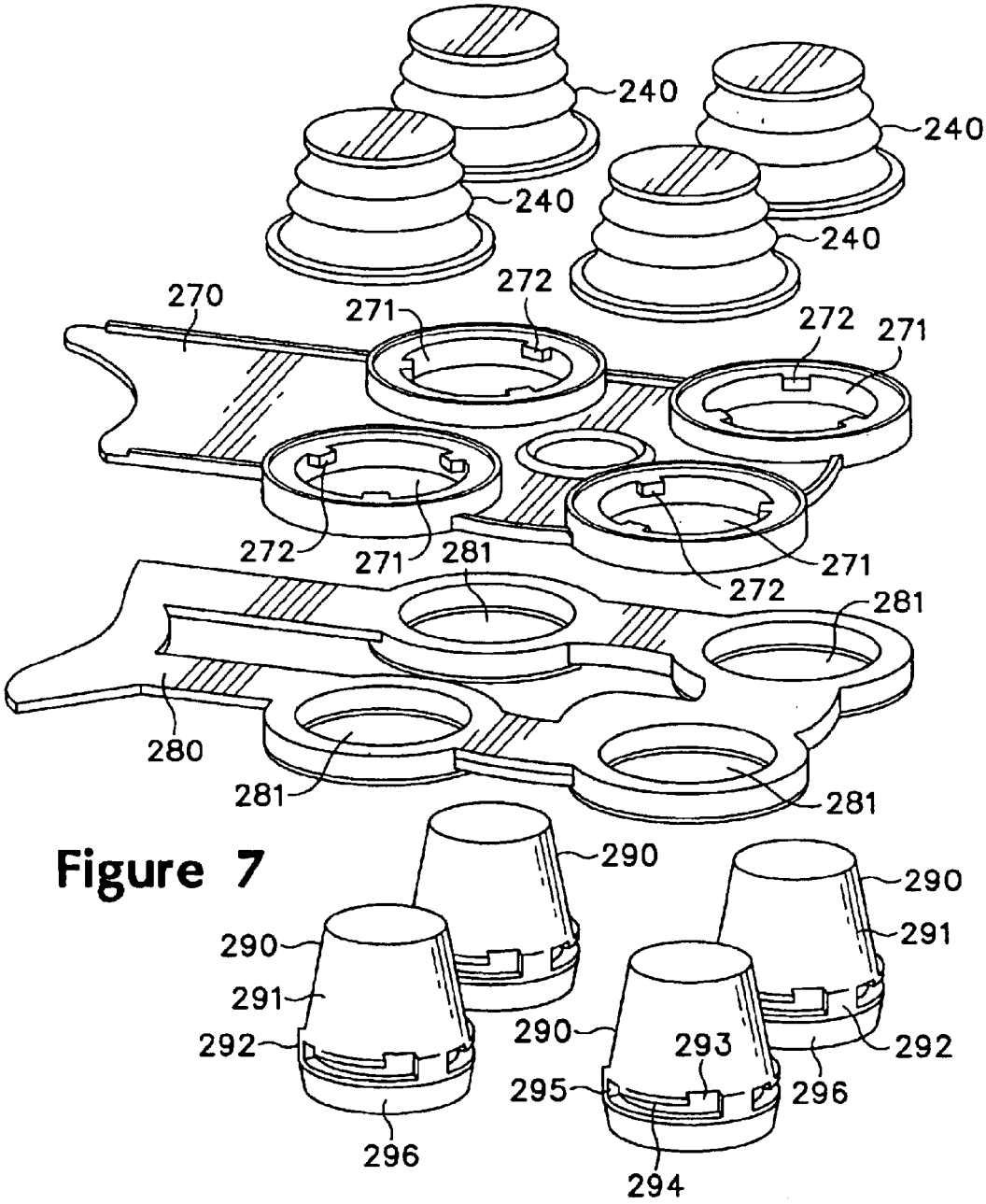
FIG. 7 is an exploded perspective view of a portion of a sole structure of the footwear depicted in FIG. 6.
Figure 8:
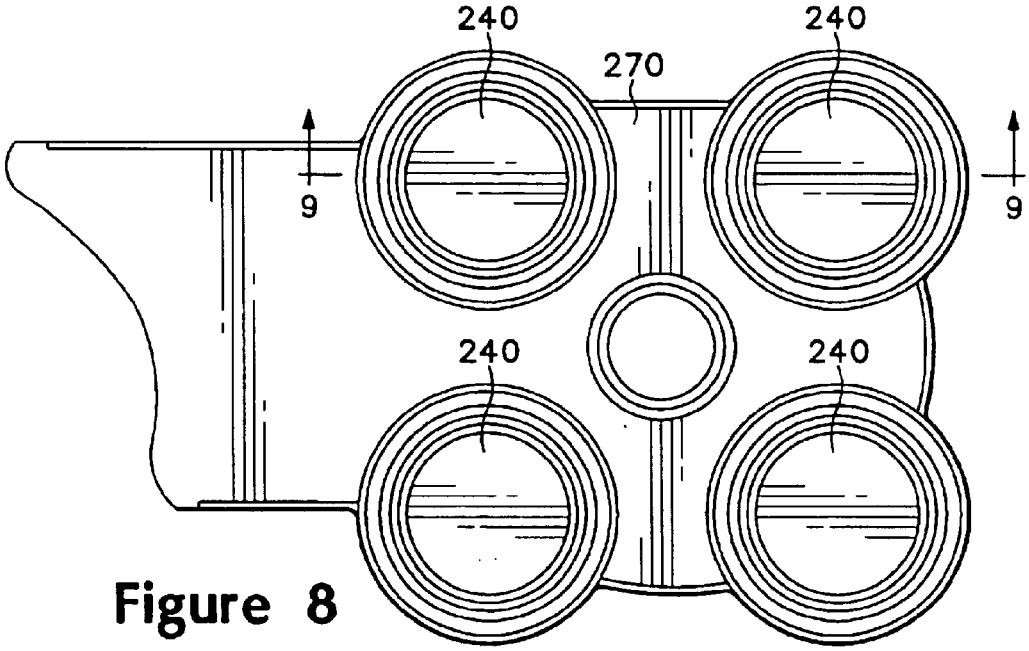
FIG. 8 is a top plan view of the portion depicted in FIG. 7.
Figure 9:
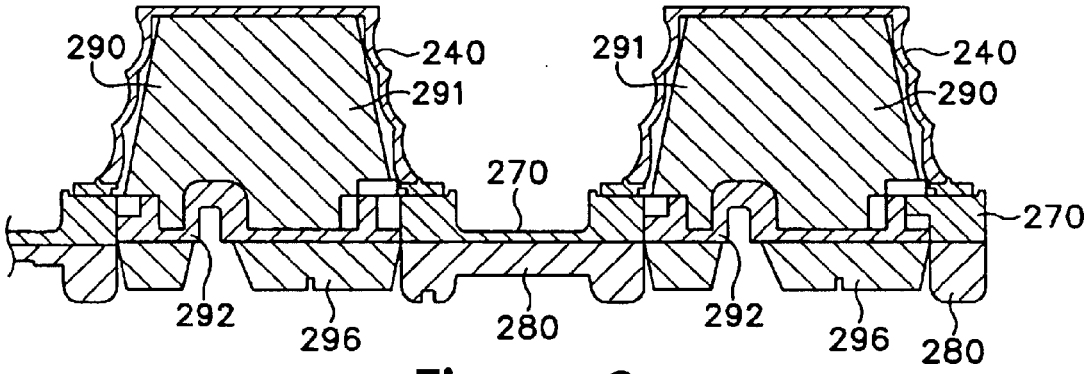
FIG. 9 is a cross-sectional view, as defined by line 9—9 in FIG. 8.
Figure 10:
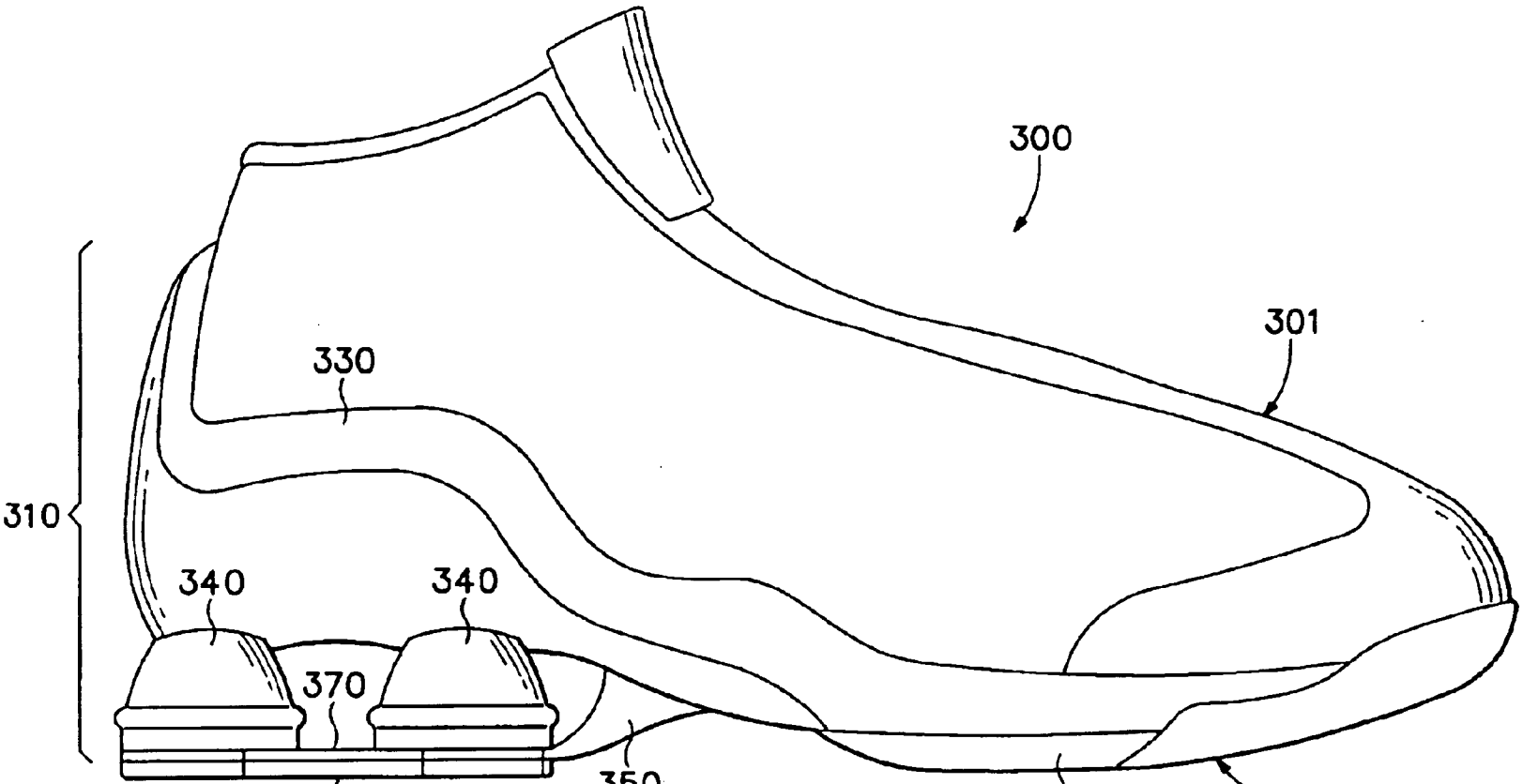
FIG. 10 is a lateral elevation view of an article of footwear in accordance with a third embodiment of the present invention.
Figure 11:
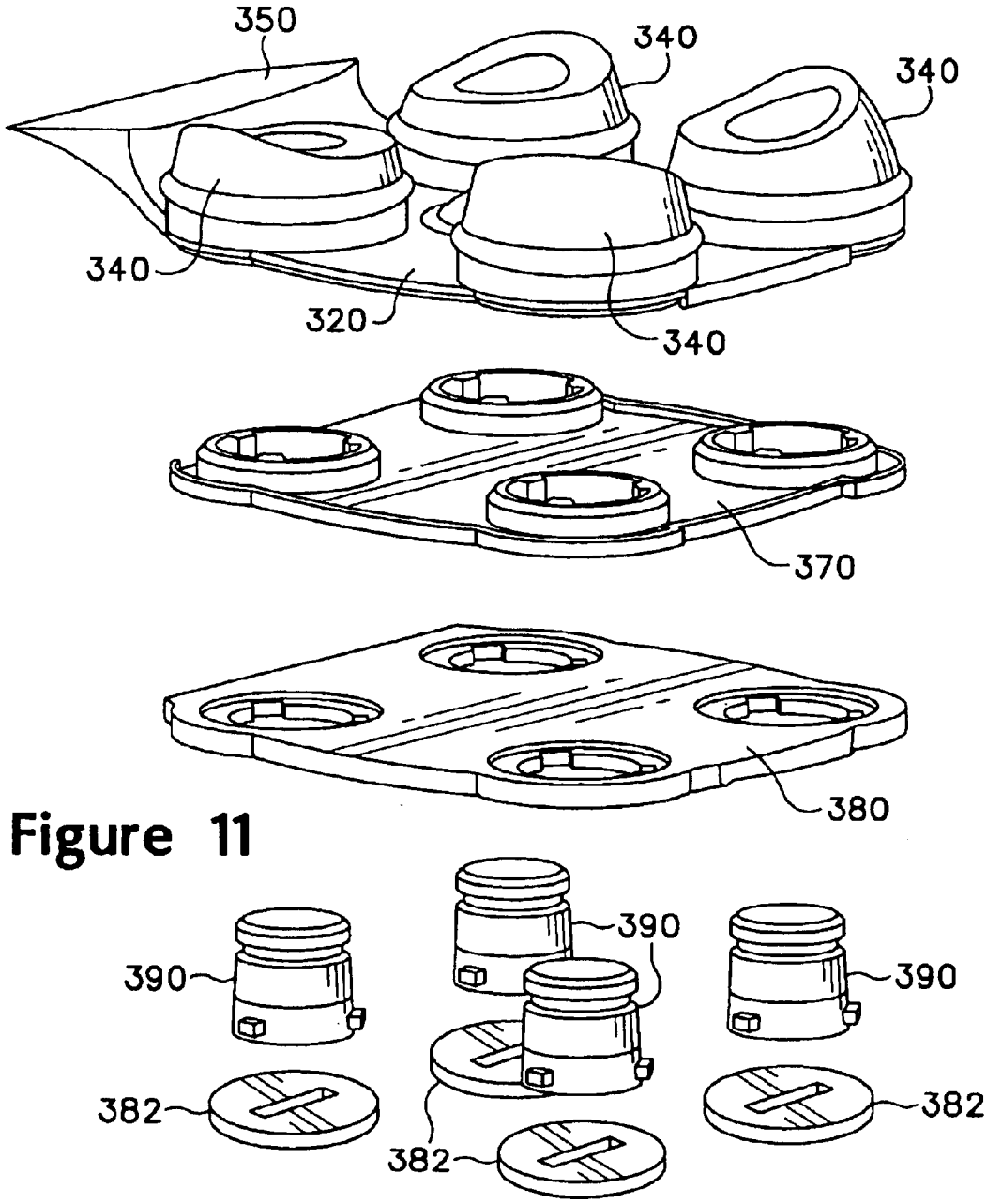
FIG. 11 is an exploded perspective view of a portion of a sole structure of the footwear depicted in FIG. 10.
Figure 12:
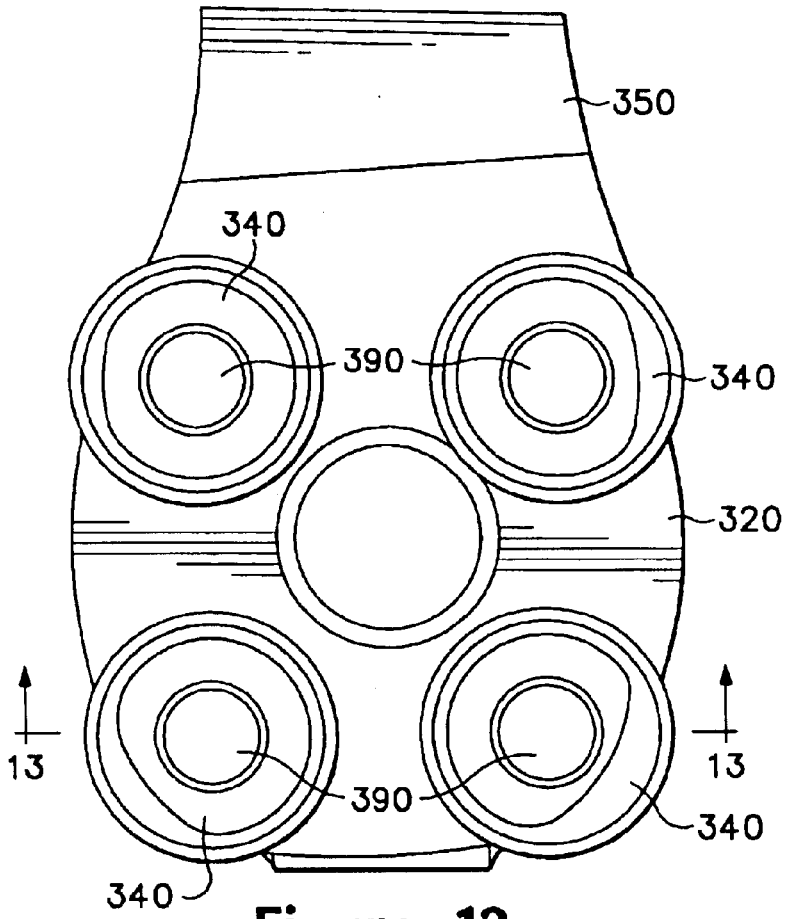
FIG. 12 is a top plan view of the portion depicted in FIG. 11.
Figure 13:
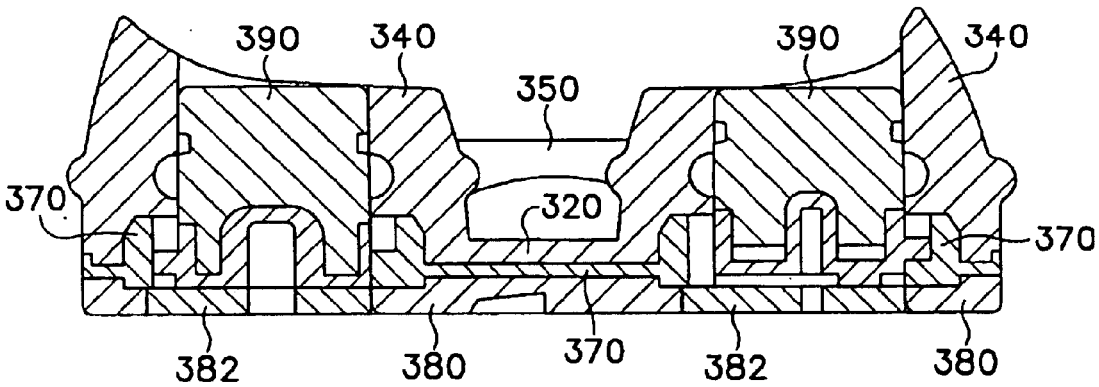
FIG. 13 is a cross-sectional view, as defined by line 13—13 in FIG. 12.

The operation of the present invention will be discussed in greater detail with reference to FIG. 5. Assume for purposes of the present discussion that footwear 100 is initially configured such that each void 141*a*–141*d* includes an identical insert 190*a*–190*d*, respectively. In this configuration, columnar elements 140*a*–140*d*, which are substantially identical in configuration and material, will encompass inserts 190*a*–190*d*, which are also substantially identical in configuration and material. Heel region 105 will, therefore, have four combinations of columnar elements 140*a*–140*d* and inserts 190*a*–190*d* that have substantially identical stiffness characteristics. This configuration may be suitable for an individual that does not over-pronate, but an individual that does over-pronate may desire sole structure 102 to have lesser stiffness in the rear-lateral corner than in other portions of heel region 105. In order to alter the stiffness characteristics of sole structure 102, the individual may replace insert 190*a* with alternate insert 190*a*'. If first portion 191 of alternate insert 190*a*' is formed of a material that is less stiff than first portion 191 of insert 190*a*, then insertion of alternate insert 190*a*' into void 141*a* will decrease the stiffness of sole structure 102 in the rear-lateral corner, thereby providing the individual with a measure of pronation control. Accordingly, the act of replacing inserts 190*a*–190*d* with alternate inserts 190*a*'–190*d*' that have different physical properties alters the characteristics of sole structure 102.

The physical characteristics that may differ between various inserts 190*a*–190*d* may relate to a variety of factors, including the materials from which inserts 190*a*–190*d* are formed, the specific properties of the materials, the shape of inserts 190*a*–190*d*, and the size of inserts 190*a*–190*d*, for example. In the above example, insert 190*a* may be formed of a foamed polyurethane, whereas alternate insert 190*a*' may be formed of a microcellular foam. Similarly, insert 190*a* and alternate insert 190*a*' may be formed from the same material, but with different densities. In addition to being formed from different materials, insert 190*a* and alternate insert 190*a*' may have different shapes, different circumferences, or different lengths, for example. Accordingly, the present invention encompasses a broad range of physical characteristics that may differ between the various inserts 190*a*–190*d* and alternate inserts 190*a*'–190*d*'.

Pronation control is not the only purpose for the present invention. As discussed above, not all individuals require or prefer the specific degree of stiffness that is predetermined by the footwear manufacturer. Individuals of different mass may prefer a sole structure that provides different degrees of stiffness. Accordingly, the individual may replace all inserts 190*a*–190*d* with alternate inserts 190*a*'–190*d*' that have a different stiffness to thereby change the overall stiffness of sole structure 102 in a desired manner. Similarly, an individual that is running on a compliant surface, such as turf or sand, may prefer that sole structure 102 have a greater stiffness. Accordingly, the individual may replace inserts 190*a*–190*d* with alternate inserts 190*a*'–190*d*' that have greater stiffness to thereby increase the overall stiffness of sole structure 102. Individuals may also find that varying the characteristics of sole structure 102 configures footwear 100 to be more suitable for specific activities, such as running versus walking.

The above discussion focuses upon alterations in the stiffness of sole structure 102 that are achieved by replacing one insert 190*a*–190*d* with an alternate insert 190*a*'–190*d*'. The structure of columnar elements 140*a*–140*d* may be designed to support the individual without the addition of inserts 190*a*–190*d*. Accordingly, the individual may opt to entirely remove one or more inserts 190*a*–190*d* to configure specific columnar elements 140*a*–140*d* for the least possible degree of stiffness.

Second Embodiment

A second embodiment of the present invention is disclosed in FIGS. 6–9 with reference to footwear 200. The primary elements of footwear 200 are an upper 201 and a sole structure 202 that is attached to upper 201. Sole structure 202 includes a midsole 210, an outsole 280, and a plurality of inserts 290. Midsole 210 further includes a foam layer 220, a top plate 230, four columnar elements 240, a midfoot wedge 250, and a bottom plate 270. Note that the design of midsole 210, as depicted in the figures, does not include rings that correspond with rings 160 of footwear 100. Different embodiments of the present invention may, therefore, have different elements to achieve the characteristic-modifying purpose of the present invention.

Columnar elements 240 have a general shape of a truncated cone and a wall thickness that is significantly thinner than the wall thickness in columnar elements 140*a*–140*d*. In the absence of inserts 290, columnar elements 240 would be unable to support the weight of the individual. Although this may seem to be an undesirable quality of footwear 200, this characteristic provides the individual greater control over the characteristics of sole structure 202. With reference to footwear 100, columnar elements 140*a*–140*d* have a thickness that is sufficient to fully support the individual. Accordingly, columnar elements 140*a*–140*d* play a significant part in determining the overall characteristics of sole structure 102. In footwear 200, however, columnar elements 240 provide significantly less support. Accordingly, inserts 290 are the primary determinant of the characteristics of sole structure 202. Inserts 290 that have a specific range of physical properties will, therefore, have a significant effect upon the overall characteristics of sole structure 202, whereas inserts 190*a*–190*d* having the same range of physical properties will not alter the characteristics of sole structure 102 to the same degree due to the effect that the thickness of columnar elements 140*a*–140*d* has upon the characteristics.

Accordingly, columnar elements 240 will have little to no affect upon the overall modifiability of sole structure 202.

Columnar elements 240 may be formed from the materials discussed relative to columnar elements 140*a*–140*d*. Due to the reduced wall thickness of columnar elements 240, however, a material that is at least semi-transparent may be utilized to permit the individual to see inserts 290. Such materials include certain formulations of thermoplastic polyurethane, nylon, and rubber, for example. This not only has the potential to provide a unique aesthetic characteristic to footwear 200, but also permits the individual to see inserts 290, which may have indicia to identify their specific physical characteristics.

Each insert 290 includes a first portion 291 and a second portion 292 formed of different materials. Whereas first portion 291 extends into voids 241 of columnar elements 240, second portion 292 protrudes through apertures 271 in bottom plate 270 and apertures 281 in outsole 280. First portion 291 may be formed of a variety of materials or have varying dimensions that provide differing ranges of characteristics. Second portion 292 may be formed of a semi-rigid material that is suitable for a securing mechanism that securely holds inserts 290 within columnar elements 240. In contrast with the securing mechanism of footwear 100, bottom plate 270 includes a protrusion 272 and each insert 290 includes a channel 293, an inclined plane 294, and a receptacle 295 that operate to guide and seat protrusion 272 when securing inserts 290 within columnar elements 240. Accordingly, the securing mechanism operates in a manner that is similar to the securing mechanism of footwear 100. Inserts 290 also include a permanently affixed cap 296 attached to a lower surface of second portion 292.

Footwear 200 is disclosed in the figures and discussed in relation to the structure of a running shoe. In further embodiments, however, columnar elements having the general structure and characteristics of columnar elements 240 may be incorporated into other styles of footwear, such as basketball shoe, for example. When incorporated into basketball shoes, columnar elements 240 may be modified to have a canted upper surface that is similar to the upper surface disclosed in the following discussion with respect to footwear 300.

Third Embodiment

Footwear 100 and footwear 200 are two embodiments of the present invention that are disclosed with reference to running shoes. Footwear 300 is depicted in FIGS. 10–13 and discloses the present invention with respect to a basketball shoe. The primary elements of footwear 300 are an upper 301 and a sole structure 302 that is attached to upper 301. Sole structure 302 includes a midsole 310, an outsole 380, and a plurality of inserts 390. Midsole 310 further includes a top plate 330 that extends around the heel of the wearer, four columnar elements 340 that have a canted upper surface, a midfoot wedge 350, and a bottom plate 370. In contrast with the prior embodiments, columnar elements 340 and midfoot wedge 350 are formed integral with a common base 320. Footwear 300 may also include caps 382 that are positioned under inserts 390.

As with the prior embodiments, inserts 390 may be interchanged with alternate inserts 390 to modify the stiffness of sole structure 302. In general, the range of motions inherent in the game of basketball is much greater than the range of motions utilized in running. For example, basketball commonly requires quick direction changes, lunges, and jumping. The footwear utilized in basketball, therefore, is generally more stable than the footwear utilized for running. To promote stability in sole structure 302, columnar elements 340 may be spaced in a relatively wide relationship in the medial-lateral direction. Furthermore, removing and replacing inserts 390 modifies to the overall characteristics of sole structure 302 to modify the stiffness and stability to the preferences of the individual.

As depicted, footwear 300 includes a securing system that is similar to the securing system incorporated into footwear 100. However, either of the securing systems disclosed with respect to footwear 100 or footwear 200 may be employed in footwear 300. Footwear 300 may also incorporate one of a plurality of alternate securing systems.

For example, bottom plate 370 may be threaded and inserts 390 may include corresponding threads. In addition, bottom plate 370 may include a protrusion that mates with an indentation in inserts 390. As disclosed above, the corresponding portions of the securing systems are located on the various bottom plates 170, 270, and 370 and the inserts 190*a*–190*d*, 290, and 390. In alternate embodiments, the securing system may also be incorporated into the various columnar elements 140*a*–140*d*, 240, and 340, for example. Additional securing systems that may be utilized include set screws, band straps, or snap rings, for example.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. A method for modifying a characteristic of a sole structure for an article of footwear, said method comprising steps of:

manufacturing at least one discrete, vertically-projecting, columnar element to include a substantially vertical void located on an interior of said columnar element;

forming a cavity with an upper surface and an opposite lower surface in said sole structure, said cavity extending through a lateral side and a medial side of said footwear to form a horizontal aperture through the sole structure;

locating said columnar element between said upper surface and said lower surface of said cavity;

providing a first insert and a second insert that are separate from said sole structure and configured to be removably-received by said void; and supplying each of said first insert and said second insert with a first securing portion of a securing mechanism and supplying said sole structure with a corresponding second securing portion of said securing mechanism, said first securing portion being joinable with said second securing portion to secure one of said first insert and said second insert within said void.

2. The method of claim 1, further including a step of inserting one of said first insert and said second insert within said void to modify said characteristic of said sole structure.

3. The method of claim 1, further including a step of removing both said first insert and said second insert from said void to modify said characteristic of said sole structure.

4. The method of claim 1, further including a step of interchanging said first insert with said second insert to modify said characteristic of said sole structure.

5. The method of claim 1, wherein the step of manufacturing includes forming an aperture through an outsole of said sole structure to provide access for said first insert and said second insert.

6. The method of claim 1, wherein the step of providing includes forming said first insert and said second insert to have different physical properties.

7. The method of claim 1, wherein the step of providing includes forming said first insert and said second insert from materials with different compressibilities.

8. The method of claim 1, further including a step of positioning said second securing portion in an aperture formed in a semi-rigid plate.

9. The method of claim 8, wherein the step of positioning includes locating said semi-rigid plate between said columnar element and an outsole.

10. A method for modifying a characteristic of a sole structure for an article of footwear, said method comprising steps of:

manufacturing at least one discrete, vertically-projecting columnar element to include an exterior surface and a substantially vertical void located on an interior of said columnar element;

forming a cavity with an upper surface and an opposite lower surface in said sole structure, said cavity extending through a lateral side and a medial side of said footwear to form a horizontal aperture through the sole structure;

locating said columnar element between said upper surface and said lower surface of said cavity such that said exterior surface is exposed within said cavity;

providing a first insert and a second insert that are separate from said sole structure and configured to be removably-received by said void, said first insert and said second insert being formed to have different physical properties;

supplying each of said first insert and said second insert with a first securing portion of a securing mechanism and supplying said sole structure with a corresponding second securing portion of said securing mechanism, said first securing portion being joinable with said second securing portion to secure one of said first insert and said second insert within said void; and selecting one of:

a first configuration, wherein said first insert is received by said void, a second configuration, wherein said second insert is received by said void, and a third configuration, wherein neither said first insert nor said second insert are received by said void.

11. The method of claim 10, wherein the step of manufacturing includes forming an aperture through an outsole of said sole structure to provide access for said first insert and said second insert.

12. The method of claim 10, wherein the step of providing includes selecting said different physical properties to be different compressibilities.

13. The method of claim 10, further including a step of positioning said second securing portion in an aperture formed in a semi-rigid plate.

14. The method of claim 13, wherein the step of positioning includes locating said semi-rigid plate between said columnar element and an outsole.

* * * * *